US012680555B2

(12) United States Patent
Tanaka

(10) Patent No.: US 12,680,555 B2
(45) Date of Patent: Jul. 14, 2026

(54) CENTRIFUGAL COMPRESSOR

(71) Applicant: IHI Corporation, Tokyo (JP)

(72) Inventor: Ryuta Tanaka, Tokyo (JP)

(73) Assignee: IHI Corporation, Tokyo (JP)

( * ) Notice: Subject to any disclaimer, the term of this patent is extended or adjusted under 35 U.S.C. 154(b) by 20 days.

(21) Appl. No.: 19/266,694

(22) Filed: Jul. 11, 2025

(65) Prior Publication Data

US 2025/0341221 A1 Nov. 6, 2025

Related U.S. Application Data

(63) Continuation of application No. PCT/JP2024/005305, filed on Feb. 15, 2024.

(30) Foreign Application Priority Data

Feb. 17, 2023 (JP) ..... 2023-023315

(51) Int. Cl.
*F04D 29/44* (2006.01)
*F04D 17/10* (2006.01)

(52) U.S. Cl.
CPC ..... *F04D 29/444* (2013.01); *F04D 17/10* (2013.01)

(58) Field of Classification Search
CPC ..... F04D 29/442; F04D 29/44; F04D 29/444; F04D 29/448; F04D 29/441; F04D 17/10; F04D 29/542; F04D 29/544; F04D 29/288; F04D 29/328
See application file for complete search history.

(56) References Cited

U.S. PATENT DOCUMENTS

| | | | |
|---|---|---|---|
| 2007/0036647 | A1 | 2/2007 | Abdelwahab et al. |
| 2008/0038114 | A1 | 2/2008 | Abdelwahab et al. |
| 2012/0014788 | A1 | 1/2012 | Blair et al. |
| 2014/0186173 | A1 | 7/2014 | Blair et al. |
| 2020/0166049 | A1 | 5/2020 | Nasir et al. |

FOREIGN PATENT DOCUMENTS

| | | | |
|---|---|---|---|
| CN | 115929694 A | * | 4/2023 |
| CN | 219282082 U | * | 6/2023 |
| DE | 20 2006 020187 U1 | | 1/2008 |
| JP | 60-184999 A | | 9/1985 |
| JP | 2010-540817 A | | 12/2010 |

(Continued)

OTHER PUBLICATIONS

International Search Report issued May 7, 2024 in PCT/JP2024/005305, filed on Feb. 15, 2024, 2 pages.

*Primary Examiner* — Nathaniel E Wiehe
*Assistant Examiner* — Maxime M Adjagbe
(74) *Attorney, Agent, or Firm* — Oblon, McClelland, Maier & Neustadt, L.L.P.

(57) ABSTRACT

Provided is a centrifugal compressor, including: a compressor impeller; and a plurality of diffuser blades arranged on an outer side of the compressor impeller in a radial direction so as to be spaced apart from each other in a circumferential direction of the compressor impeller, the diffuser blades each with: a blade angle having a local maximum value, the blade angle being an angle formed between a center line of the diffuser blade and the radial direction; and a thickness having a local maximum on a downstream side of a position at which the blade angle has the local maximum value.

4 Claims, 4 Drawing Sheets

(56) References Cited

FOREIGN PATENT DOCUMENTS

| | | | |
|---|---|---|---|
| JP | 2011-252424 | A | 12/2011 |
| JP | 2013-124624 | A | 6/2013 |
| JP | 2013-531186 | A | 8/2013 |
| JP | 2022-78460 | A | 5/2022 |
| WO | 2012/019650 | A1 | 2/2012 |

* cited by examiner

CENTRIFUGAL COMPRESSOR

CROSS REFERENCE TO RELATED APPLICATIONS

This application is a continuation application of International Application No. PCT/JP2024/005305, filed on Feb. 15, 2024, which claims priority to Japanese Patent Application No. 2023-023315, filed on Feb. 17, 2023, the entire contents of which are incorporated by reference herein.

BACKGROUND ART

Technical Field

The present disclosure relates to a centrifugal compressor. This application claims the benefit of priority to Japanese Patent Application No. 2023-023315 filed on Feb. 17, 2023, and contents thereof are incorporated herein.

Related Art

There exists a centrifugal compressor including a diffuser for converting kinetic energy of fluid compressed by a compressor impeller into pressure energy. In such a centrifugal compressor, as disclosed in, for example, Patent Literature 1, a plurality of diffuser blades are arranged on a radially outer side of the compressor impeller so as to be spaced apart from each other in a circumferential direction of the compressor impeller. The passage of fluid between the diffuser blades adjacent to each other decreases a flow velocity of the fluid to thereby increase a pressure.

CITATION LIST

Patent Literature

Patent Literature 1: JP 2013-124624 A

SUMMARY

Technical Problem

When the centrifugal compressor is used under a condition in which a flow rate of fluid is small, there arises a need for reducing a throat area, which is a flow passage sectional area of a throat portion. The throat portion is a portion having a minimum flow passage sectional area between the diffuser blades adjacent to each other. Thus, it is desired that the throat area be appropriately reduced.

An object of the present disclosure is to provide a centrifugal compressor that allows a throat area to be appropriately reduced.

Solution to Problem

In order to solve the above-mentioned problem, according to the present disclosure, there is provided a centrifugal compressor, including: a compressor impeller; and a plurality of diffuser blades arranged on an outer side of the compressor impeller in a radial direction so as to be spaced apart from each other in a circumferential direction of the compressor impeller, the diffuser blades each with: a blade angle having a local maximum value, the blade angle being an angle formed between a center line of the diffuser blade and the radial direction; and a thickness having a local maximum on a downstream side of a position at which the blade angle has the local maximum value.

The plurality of diffuser blades may include a first diffuser blade and a second diffuser blade adjacent to the first diffuser blade in a rotating direction of the compressor impeller, and the blade angle of the second diffuser blade may have the local maximum value at a position on the second diffuser blade, the position corresponding to a position that is orthogonal to a center line of the first diffuser blade and is opposed to a downstream end of the first diffuser blade.

The plurality of diffuser blades may include a first diffuser blade and a second diffuser blade adjacent to the first diffuser blade in a rotating direction of the compressor impeller, and the thickness of the first diffuser blade may have the local maximum at a position on the first diffuser blade, the position corresponding to a position that is orthogonal to a center line of the second diffuser blade and is opposed to an upstream end of the second diffuser blade.

Effects

According to the present disclosure, it is possible to appropriately reduce a throat area.

DESCRIPTION OF EMBODIMENTS

Figure 1:
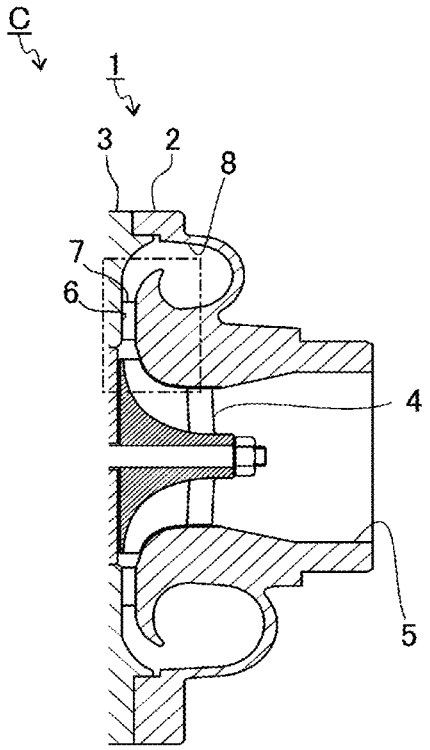
FIG. 1 is a schematic sectional view of a centrifugal compressor according to an embodiment of the present disclosure.

Now, with reference to the attached drawings, an embodiment of the present disclosure is described. The dimensions, materials, and other specific numerical values represented in the embodiment are merely examples used for facilitating the understanding of the disclosure, and do not limit the present disclosure unless otherwise particularly noted. Elements having substantially the same functions and configurations herein and in the drawings are denoted by the same reference symbols to omit redundant description thereof. Further, illustration of elements with no direct relationship to the present disclosure is omitted.

FIG. 1 is a sectional view of a centrifugal compressor C according to this embodiment. As illustrated in FIG. 1, the centrifugal compressor C includes: a housing 1 including a first housing 2 and a second housing 3; and a compressor impeller 4.

A rotation axis direction, a radial direction, and a circumferential direction of the compressor impeller 4 are hereinafter also referred to simply as "rotation axis direction", "radial direction", and "circumferential direction", respectively.

The first housing 2 and the second housing 3 are arranged in line in the rotation axis direction. The first housing 2 and the second housing 3 are coupled to each other with use of, for example, a fastening mechanism such as a G coupling. The compressor impeller 4 is housed rotatably in the housing 1.

An inlet port 5 is formed in an end portion of the first housing 2, which is opposite to the second housing 3. A diffuser flow passage 6 is defined between the first housing 2 and the second housing 3. The diffuser flow passage 6 has an annular shape. The diffuser flow passage 6 is positioned on a radially outer side with respect to the compressor impeller 4. The diffuser flow passage 6 is in communication with the inlet port 5 through the compressor impeller 4. A plurality of diffuser blades 7 are provided in the diffuser flow passage 6. Details of the diffuser blades 7 are described later.

A compressor scroll flow passage 8 is formed in the first housing 2. The compressor scroll flow passage 8 has an annular shape. The compressor scroll flow passage 8 is located on a radially outer side with respect to the diffuser flow passage 6. The compressor scroll flow passage 8 is in communication with the diffuser flow passage 6. Further, the compressor scroll flow passage 8 is in communication with a discharge port (not shown).

In the centrifugal compressor C, when the compressor impeller 4 is rotated, fluid such as air is sucked from the inlet port 5 into the first housing 2. A velocity of the sucked fluid is increased by a centrifugal force while the sucked fluid is passing through spaces between vanes of the compressor impeller 4. The fluid having an increased velocity is pressurized in the diffuser flow passage 6 and the compressor scroll flow passage 8. The pressurized fluid flows out from the discharge port (not shown).

Figure 2:
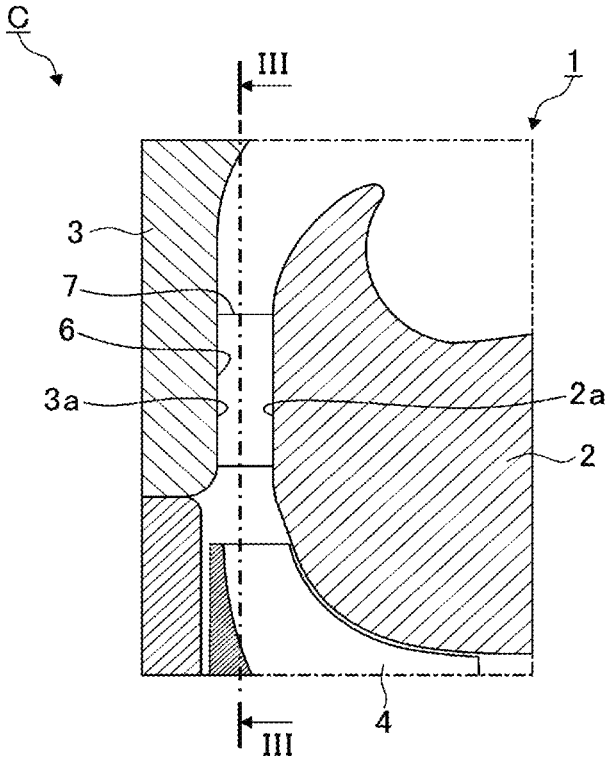
FIG. 2 is an extracted view of an area indicated by a dash-dotted line of FIG. 1.
Figure 3:
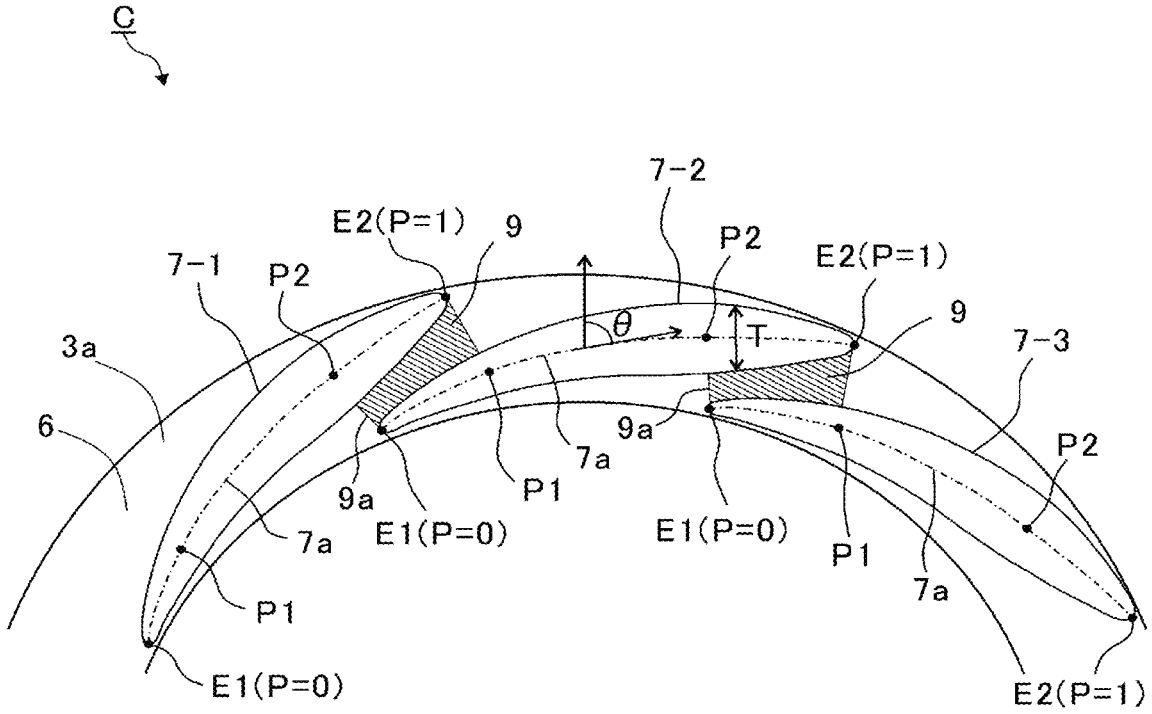
FIG. 3 is a sectional view taken along the line III-III of FIG. 2.

Now, details of the diffuser blades 7 are described with reference to FIG. 2 to FIG. 4. FIG. 2 is an extracted view of an area indicated by a dash-dotted line of FIG. 1. FIG. 3 is a sectional view taken along the line III-III of FIG. 2. In FIG. 3, only diffuser blades 7-1, 7-2, and 7-3, which are some of the plurality of diffuser blades 7, are illustrated in FIG. 3.

As illustrated in FIG. 2, the diffuser flow passage 6 is defined between a surface 2*a* of the first housing 2 and a surface 3*a* of the second housing 3. The surface 2*a* and the surface 3*a* are opposed to each other in the rotation axis direction. For example, each of the surface 2*a* and the surface 3*a* expands orthogonally in the rotation axis direction. The surface 2*a* and the surface 3*a* are, for example, parallel to each other.

As illustrated in FIG. 2 and FIG. 3, the plurality of diffuser blades 7 are arranged on the radially outer side of the compressor impeller 4 so as to be spaced apart from each other in the circumferential direction of the compressor impeller 4. In this embodiment, the diffuser blades 7 have substantially congruent shapes. That is, in this embodiment, a first diffuser blade described later and a second diffuser blade described later (that is, the diffuser blade 7 adjacent to the first diffuser blade in a rotating direction of the compressor impeller 4) have substantially congruent shapes. The diffuser blades 7 are each provided so as to extend between the surface 2*a* of the first housing 2 and the surface 3*a* of the second housing 3. The diffuser blades 7 are each fixed to the surface 2*a* and the surface 3*a*.

However, the diffuser blades 7 are not always required to be fixed to the surface 2*a* and may be, for example, spaced apart from the surface 2*a*. The diffuser blades 7 are not always required to be fixed to the surface 3*a* and may be, for example, spaced apart from the surface 3*a*. The diffuser blades 7 may be formed integrally with the first housing 2 or may be members separate from the first housing 2. The diffuser blades 7 may be formed integrally with the second housing 3 or may be members separate from the second housing 3.

As illustrated in FIG. 3, the diffuser blades 7 extend to intersect with the radial direction of the compressor impeller 4. Specifically, a center line 7*a* of each of the diffuser blades 7 extends to intersect with the radial direction of the compressor impeller 4. The plurality of diffuser blades 7 are arranged equiangularly. Specifically, the plurality of diffuser blades 7 are arranged rotationally symmetrical about the rotation axis of the compressor impeller 4. However, a distance between some diffuser blades 7 which are adjacent to each other may be different from a distance between other diffuser blades 7 which are adjacent to each other.

When the fluid sent from the compressor impeller 4 to the radially outer side passes through flow passages 9 between the diffuser blades 7 which are adjacent to each other, a flow velocity of the fluid decreases to thereby increase a pressure. As a result, the fluid is pressurized in the diffuser flow passage 6. As described above, the fluid flows from a radially inner side toward the radially outer side in the diffuser flow passage 6. Thus, a radially inner end portion of each of the diffuser blades 7 is an upstream end E1, and a radially outer end portion of each of the diffuser blades 7 is a downstream end E2.

The flow passage 9 is defined between a downstream-side portion of the diffuser blade 7 (for example, the diffuser blade 7-1), which includes the downstream end E2, and an upstream-side portion of the diffuser blade 7 (for example, the diffuser blade 7-2) adjacent to the above-mentioned diffuser blade 7, which includes the upstream end E1. A portion of the flow passage 9, which has a minimum flow passage sectional area, is a throat portion 9*a*. The throat portion 9*a* is formed at an upstream end of the flow passage 9. In this embodiment, an appropriate reduction in throat area, which is a flow passage sectional area of the throat portion 9*a*, can be achieved by suitably designing a shape of the diffuser blade 7.

In the example of FIG. 3, the diffuser blades 7-1, 7-2, and 7-3 are arranged in the stated order in the circumferential direction. That is, the diffuser blade 7-1 and the diffuser blade 7-2 are adjacent to each other. The diffuser blade 7-2 and the diffuser blade 7-3 are adjacent to each other. In FIG. 3, the rotating direction of the compressor impeller 4 is a clockwise direction. That is, the diffuser blade 7-2 is adjacent to the diffuser blade 7-1 in the rotating direction of the compressor impeller 4. The diffuser blade 7-3 is adjacent to the diffuser blade 7-2 in the rotating direction of the compressor impeller 4.

Figure 4:
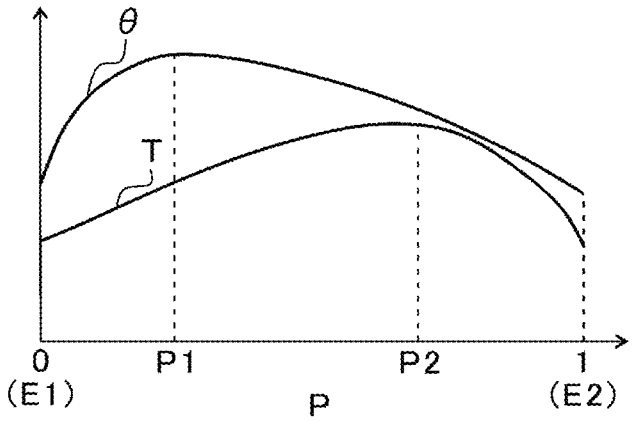
FIG. 4 is a graph for showing one example of distributions of a blade angle and a thickness of a diffuser blade.

In FIG. 3 and FIG. 4, a position on the diffuser blade 7 is represented by a dimensionless position P along the center line 7*a* of the diffuser blade 7. The dimensionless position P is 0 at the upstream end E1 and is 1 at the downstream end E2.

FIG. 4 is a graph for showing one example of distributions of a blade angle θ and a thickness T of the diffuser blade 7. The blade angle θ is an angle formed between the center line 7*a* of the diffuser blade 7 and the radial direction of the compressor impeller 4 (see FIG. 3). The thickness T is a length of the diffuser blade 7 in a direction orthogonal to the center line 7*a* when the diffuser blade 7 is viewed in the rotation axis direction (see FIG. 3).

As shown in FIG. 4, on the diffuser blade 7, the blade angle θ has a local maximum value. In the example of FIG. 4, the blade angle θ increases as approaching from the upstream end E1 toward a position P1. The position P1 is a position between the upstream end E1 and the downstream end E2. Then, the blade angle θ decreases as approaching from the position P1 toward the downstream end E2. That is, at the position P1, the blade angle θ has a local maximum value (maximum value in this embodiment). Regarding the blade angle θ having a local maximum, the blade angle θ may have a local maximum not only at a point but also over a certain range (region having a constant blade angle θ). The range may be equal to or less than a maximum value of the thickness T of the diffuser blade 7, which is described later.

As shown in FIG. 4, the thickness T of the diffuser blade 7 has a local maximum on a downstream side of the position P1 at which the blade angle θ has the local maximum value. In the example of FIG. 4, the thickness T increases as approaching from the upstream end E1 toward a position P2. The position P2 is a position that is located between the upstream end E1 and the downstream end E2, and is located on the downstream side of the position P1. Then, the thickness T decreases as approaching from the position P2 toward the downstream end E2. That is, at the position P2, the thickness T has a local maximum (maximum in this embodiment). Regarding the thickness T having a local maximum, the thickness T may have a local maximum not only at a point but also over a certain range (region having a constant thickness T). The range may be equal to or less than the maximum value of the thickness T of the diffuser blade 7.

In the example of FIG. 4, the blade angle θ monotonically decreases as approaching toward the downstream side E2 and the thickness T monotonically increases as approaching toward the downstream end E2, on the downstream side of the position P1 and on the upstream side of the position P2. In this embodiment, the blade angle θ and the thickness T constantly decreases and increases as approaching toward the downstream end E2, respectively. In the present disclosure, however, the monotonical decrease and the monotonical increase may each include a part in which the blade angle θ or the thickness T remains unchanged. That is, the monotonical decrease and the monotonical increase of the present disclosure also include a monotonical decrease in a broad sense and a monotonical increase in a broad sense.

As described above, the centrifugal compressor C includes the plurality of diffuser blades 7, each with the blade angle θ having the local maximum value and the thickness T having the local maximum on the downstream side of the position P1 at which the blade angle θ has the local maximum value. With the blade angle θ having the local maximum value on the upstream side of the position P2 at which the thickness T has the local maximum, the position P1 at which the blade angle θ has the local maximum value can be set on an upstream-side portion of the diffuser blade 7. Thus, the upstream-side portion of the diffuser blade 7 (for example, the diffuser blade 7-2) can be set closer to a downstream-side portion of the diffuser blade 7 (for example, the diffuser blade 7-1) adjacent to the above-mentioned diffuser blade 7. Further, with the thickness T having the local maximum on the downstream side of the position P1 at which the blade angle θ has the local maximum value, the position P2 at which the thickness T has the local maximum can be set on a downstream-side portion of the diffuser blade 7. Thus, the downstream-side portion of the diffuser blade 7 (for example, the diffuser blade 7-1) can be set closer to an upstream-side portion of the diffuser blade 7 (for example, the diffuser blade 7-2) adjacent to the above-mentioned diffuser blade 7. As a result, the throat area of the flow passage 9 defined between the diffuser blades 7 adjacent to each other can be reduced.

Other methods are also conceivable as a method of reducing the throat area of the flow passage 9. For example, increasing the number of diffuser blades 7 is conceivable as the method of reducing the throat area of the flow passage 9. With this method, however, it is difficult to process and assemble the components of the centrifugal compressor C. For example, reducing a height of the diffuser flow passage 6 in the rotation axis direction is conceivable as the method of reducing the throat area of the flow passage 9. Also with this method, however, it is difficult to process and assemble the components of the centrifugal compressor C. For example, increasing the blade angle θ in the entire diffuser blade 7 is conceivable as the method of reducing the throat area of the flow passage 9. With this method, however, pressure loss increases due to an excessively large blade angle θ at the downstream end E2 in comparison to an appropriate value.

Meanwhile, in this embodiment, the throat area can be reduced while problems such as difficult manufacture of the centrifugal compressor C and an increase in pressure loss are eliminated. As described above, according to this embodiment, the throat area can be appropriately reduced. Thus, even when the centrifugal compressor C is used under a condition in which a flow rate of fluid is small, the fluid can be appropriately pressurized in the diffuser flow passage 6.

In the centrifugal compressor C, in particular, the plurality of diffuser blades 7 include the first diffuser blade and the second diffuser blade adjacent to the first diffuser blade in the rotating direction of the compressor impeller 4. The blade angle θ of the second diffuser blade has the local maximum value at a position on the second diffuser blade, which corresponds to a position that is orthogonal to the center line 7*a* of the first diffuser blade and is opposed to the downstream end E2 of the first diffuser blade.

For example, in the example of FIG. 3, when the diffuser blade 7-1 is the above-mentioned first diffuser blade, the diffuser blade 7-2 is the above-mentioned second diffuser blade. A position on the diffuser blade 7-2, which is orthogonal to the center line 7*a* of the diffuser blade 7-1 and is opposed to the downstream end E2 of the diffuser blade 701, is, for example, a position on the center line 7*a* of the diffuser blade 7-2, at which a normal from the downstream end E2 of the center line 7*a* of the diffuser blade 7-1 intersects with the center line 7*a* of the diffuser blade 7-2. At such a position, the position P1 on the diffuser blade 7-2 is set. As a result, the upstream-side portion of the diffuser blade 7-2 can be appropriately set closer to the downstream-side portion of the diffuser blade 7-1.

However, a position shifted by some degree from the position on the second diffuser blade (for example, the diffuser blade 7-2), which is orthogonal to the center line 7*a* of the first diffuser blade (for example, the diffuser blade 7-1) and is opposed to the downstream end E2 of the first diffuser blade, is also included in the position on the second diffuser blade, which corresponds to the position that is orthogonal to the center line 7*a* of the first diffuser blade and is opposed to the downstream end E2 of the first diffuser blade. For example, the position P1 on the diffuser blade 7-2 may be set to fall within a predetermined range (for example, a range of ±0.1 from the dimensionless position P) on the diffuser blade 7-2, which includes, as a center, the position that is orthogonal to the center line 7*a* of the diffuser blade 7-1 and is opposed to the downstream end E2 of the diffuser blade 7-1.

In the centrifugal compressor C, in particular, the plurality of diffuser blades 7 include the first diffuser blade and the second diffuser blade adjacent to the first diffuser blade in the rotating direction of the compressor impeller 4. The thickness T of the first diffuser blade has the local maximum at a position on the first diffuser blade, which corresponds to a position that is orthogonal to the center line 7*a* of the second diffuser blade and is opposed to the upstream end E1 of the second diffuser blade.

For example, in the example of FIG. 3, as described above, when the diffuser blade 7-1 is the above-mentioned first diffuser blade, the diffuser blade 7-2 is the above-mentioned second diffuser blade. A position on the diffuser blade 7-1, which is orthogonal to the center line 7*a* of the diffuser blade 7-2 and is opposed to the upstream end E1 of the diffuser blade 7-2, is, for example, a position on the center line 7*a* of the diffuser blade 7-1, at which a normal from the upstream end E1 of the center line 7*a* of the diffuser blade 7-2 intersects with the center line 7*a* of the diffuser blade 7-1. At such a position, the position P2 on the diffuser blade 7-1 is set. As a result, the downstream-side portion of the diffuser blade 7-1 can be appropriately set closer to the upstream-side portion of the diffuser blade 7-2.

However, a position shifted by some degree from the position on the first diffuser blade (for example, the diffuser blade 7-1), which is orthogonal to the center line 7*a* of the second diffuser blade (for example, the diffuser blade 7-2) and is opposed to the upstream end E1 of the second diffuser blade, is also included in the position on the first diffuser blade, which corresponds to the position that is orthogonal to the center line 7*a* of the second diffuser blade and is opposed to the upstream end E1 of the second diffuser blade. For example, the position P2 on the diffuser blade 7-1 may be set to fall within a predetermined range (for example, a range of ±0.1 from the dimensionless position P) on the diffuser blade 7-1, which includes, as a center, the position that is orthogonal to the center line 7*a* of the diffuser blade 7-2 and is opposed to the upstream end E1 of the diffuser blade 7-2.

In the example of FIG. 3, as a result of the setting of the position P1 and the position P2 on each of the diffuser blades 7 as described above, the position P1 on the diffuser blade 7-1, the position P2 on the diffuser blade 7-1, the position P1 on the diffuser blade 7-2, the position P2 on the diffuser blade 7-2, the position P1 on the diffuser blade 7-3, and the position P2 on the diffuser blade 7-3 are arranged in the stated order in the circumferential direction.

One example of the distributions of the blade angle θ and the thickness T of the diffuser blade 7 has been described above with reference to FIG. 4. However, the distributions of the blade angle θ and the thickness T of the diffuser blade 7 are not limited to those of the example of FIG. 4. For example, the blade angle θ may have local maximum values at a plurality of positions on one diffuser blade 7. For example, a region in which the blade angle θ decreases as approaching toward the downstream end E2 may be additionally defined on the upstream side of the position P1. For example, a region in which the blade angle θ increases as approaching toward the downstream side E2 may be additionally defined on the downstream side of the position P1. For example, the position at which the thickness T has a local maximum may be a range, or the thickness T may have local maxima at a plurality of positions.

An embodiment of the present disclosure has been described above with reference to the attached drawings, but, needless to say, the present disclosure is not limited to the above-mentioned embodiment. It is apparent that those skilled in the art may arrive at various alternations and modifications within the scope of claims, and those examples are construed as naturally falling within the technical scope of the present disclosure.

The invention claimed is:

1. A centrifugal compressor, comprising:

a compressor impeller; and a plurality of diffuser blades arranged on an outer side of the compressor impeller in a radial direction so as to be spaced apart from each other in a circumferential direction of the compressor impeller, the plurality of diffuser blades each with: a blade angle having a local maximum value, the blade angle being an angle formed between a center line of the diffuser blade and the radial direction; and a thickness having a local maximum on a downstream side of a position at which the blade angle has the local maximum value, wherein the blade angle monotonically increases as approaching from an upstream end of the diffuser blade toward the position at which the blade angle has the local maximum value, and monotonically decreases as approaching from the position at which the blade angle has the local maximum value toward a downstream end of the diffuser blade.

2. The centrifugal compressor according to claim 1, wherein the plurality of diffuser blades include a first diffuser blade and a second diffuser blade adjacent to the first diffuser blade in a rotating direction of the compressor impeller, and wherein the blade angle of the second diffuser blade has the local maximum value at a position on the second diffuser blade, the position corresponding to a position that is orthogonal to a center line of the first diffuser blade and is opposed to a downstream end of the first diffuser blade.

3. The centrifugal compressor according to claim 1, wherein the plurality of diffuser blades include a first diffuser blade and a second diffuser blade adjacent to the first diffuser blade in a rotating direction of the compressor impeller, and wherein the thickness of the first diffuser blade has the local maximum at a position on the first diffuser blade, the position corresponding to a position that is orthogonal to a center line of the second diffuser blade and is opposed to an upstream end of the second diffuser blade.

4. The centrifugal compressor according to claim 2, wherein the plurality of diffuser blades include a first diffuser blade and a second diffuser blade adjacent to the first diffuser blade in a rotating direction of the compressor impeller, and wherein the thickness of the first diffuser blade has the local maximum at a position on the first diffuser blade, the position corresponding to a position that is orthogonal to a center line of the second diffuser blade and is opposed to an upstream end of the second diffuser blade.

* * * * *